US009963873B2

(12) United States Patent
Hall et al.

(10) Patent No.: US 9,963,873 B2
(45) Date of Patent: May 8, 2018

(54) FLEXIBLE, SOUND-ATTENUATING ROLL-UP WALL SYSTEM

(71) Applicants: David R. Hall, Provo, UT (US); Andrew Priddis, Mapleton, UT (US); Charles Wood, Provo, UT (US); Joe Fox, Spanish Fork, UT (US); Kelly Knight, Provo, UT (US)

(72) Inventors: David R. Hall, Provo, UT (US); Andrew Priddis, Mapleton, UT (US); Charles Wood, Provo, UT (US); Joe Fox, Spanish Fork, UT (US); Kelly Knight, Provo, UT (US)

( * ) Notice: Subject to any disclaimer, the term of this patent is extended or adjusted under 35 U.S.C. 154(b) by 0 days. days.

(21) Appl. No.: 15/277,169

(22) Filed: Sep. 27, 2016

(65) Prior Publication Data

US 2018/0087266 A1 Mar. 29, 2018

(51) Int. Cl.

| | |
|---|---|
| ***E04B 2/88*** | (2006.01) |
| ***E04B 1/82*** | (2006.01) |
| ***G10K 11/162*** | (2006.01) |
| ***E04B 2/72*** | (2006.01) |

(52) U.S. Cl.

CPC ..... *E04B 1/82* (2013.01); *E04B 2/721* (2013.01); *E04B 2/88* (2013.01); *G10K 11/162* (2013.01)

(58) Field of Classification Search

CPC .. E04B 1/82; E04B 2/88; E04B 2/721; G10K 11/162

USPC ..... 181/284, 286, 287

See application file for complete search history.

(56) References Cited

U.S. PATENT DOCUMENTS

| | | | | | |
|---|---|---|---|---|---|
| 3,481,388 | A * | 12/1969 | Smart | E06B 3/94 | 160/206 |
| 4,047,337 | A * | 9/1977 | Bergstrom | A47G 5/00 | 16/225 |
| 5,123,874 | A * | 6/1992 | White, III | E04B 1/34321 | 181/290 |
| 5,217,771 | A * | 6/1993 | Schmanski | E01F 8/0011 | 181/284 |
| 5,274,200 | A * | 12/1993 | Das | E04B 1/8218 | 181/202 |
| 6,029,770 | A * | 2/2000 | Schneider | E04B 1/8218 | 181/285 |
| 7,357,219 | B2 * | 4/2008 | Mafi | F24F 1/12 | 181/200 |

(Continued)

*Primary Examiner* — Forrest M Phillips

(57) ABSTRACT

The present invention is directed to a roll-up, flexible, sound-attenuating wall system. More particularly, this invention relates to a retractable wall system and its components which may be used to divide existing larger spaces into smaller spaces with sound-attenuating barriers. In each unit the flexible, sound-attenuating wall is attached to a receiver tube which, when turned on its axis, deploys or retracts the flexible, sound-attenuating wall. The flexible, sound-attenuating wall is guided by a guide roller to intersect with other flexible, sound-attenuating walls at various angles. The receiver tube and guide roller are attached at either end to independent support brackets. This invention discloses a plurality of interlocking connector systems for connecting a plurality of flexible, sound-attenuating walls at various angles. Further, this invention discloses a winding mechanism disposed in and attached to receiver tube which turns the receiver tube on its longitudinal axis to deploy or retract the flexible, sound-attenuating wall.

14 Claims, 12 Drawing Sheets

(56) References Cited

U.S. PATENT DOCUMENTS

| | | | | |
|---|---|---|---|---|
| 7,503,429 | B2 * | 3/2009 | Boyce | B60R 13/02 181/210 |
| 7,779,964 | B2 * | 8/2010 | Birch | E04B 1/86 181/284 |
| 7,866,103 | B2 * | 1/2011 | Marschke | E04B 1/14 181/287 |
| 7,905,323 | B2 * | 3/2011 | Larsen | G10K 11/172 181/286 |
| 7,992,678 | B2 * | 8/2011 | Pilaar | B32B 27/40 181/207 |
| 8,136,626 | B1 * | 3/2012 | Aliev | F24F 13/24 181/198 |
| 9,499,977 | B2 * | 11/2016 | Strand | E04B 1/994 |
| 2013/0001011 | A1 * | 1/2013 | Panosh | G10K 11/16 181/287 |
| 2016/0130806 | A1 * | 5/2016 | Strand | E04B 1/994 181/287 |

* cited by examiner

FLEXIBLE, SOUND-ATTENUATING ROLL-UP WALL SYSTEM

BACKGROUND

Field of the Invention

This invention generally relates to systems for retractable and roll-up walls. More particularly, this invention relates to flexible, sound-attenuating roll-up walls where a plurality of walls may be interlocked at various angles and used to divide space, create acoustic barriers, or create smaller sound-attenuating spaces within a larger space.

Background of the Invention

A retractable or roll-up wall comprises one or more flexible sheets of various materials that are wound about a roller or otherwise coiled above an open space. To create a wall, partition, or divider within a larger space, the flexible sheet is deployed downward from the roller. Retractable and roll-up walls provide the ability to divide space in short sections, along a longer continuum, and in some applications into smaller cordoned spaces within a larger space. Retractable and roll-up walls provide flexibility in space structure and usage, and may be preferred over permanent walls in some applications. In some existing applications, retractable and roll-up walls may be frame mounted with posts at each angled intersection, to which the retractable or roll-up wall may be connected when deployed. When retracted, the wall is no longer disposed in the space, but the problem remains that the corner posts are still present. Where a framework is required to deploy a retractable or roll-up wall system, additional time and expense is required in each instance of deploying or removing the framework prior to a deploying the roll-up walls and after retracting the roll-up walls. Some applications may require sound-resistance which may not be achieved by typical flexible wall material used in retractable walls. The need exists for the ability to create smaller independent spaces with greater flexibility.

SUMMARY

This invention has been developed in response to the present state of the art and, in particular, in response to the problems and needs in the art that have not yet been fully solved by currently available retractable or roll-up wall systems and deployment methods. Accordingly, a flexible, sound-attenuating, interlocking, roll-up wall system has been developed that interlocks at various angles when deployed, that disengages and retracts upward when not required, and without the need for corner structures that remain after retraction of the wall or manual deployment of a support structure, and for reduced sound transfer between spaces. Features and advantages of different embodiments of the invention will become more fully apparent from the following description and appended claims, or may be learned by practice of the invention as set forth hereinafter.

Consistent with the foregoing, a flexible, sound-attenuating roll-up wall system is disclosed. The composition of the flexible, sound-attenuating material is disclosed. A system to align the vertical sides of a plurality of flexible, sound-attenuating roll-up walls at various angles as they deploy is disclosed. An interlocking connector system is disclosed. A means for winding the receiver tube to raise or lower the flexible, sound-attenuating wall is disclosed.

Wall is defined as any wall, partition, or divider used for the purpose of cordoning off a section of a larger space to create smaller spaces. Although any number of embodiments may be considered, the following suggest a few examples: a room of the dimension 10 feet by 20 feet may be divided into two rooms, each room 10 feet by 10 feet, by deploying a single flexible, sound-attenuating wall; a room 20 feet by 20 feet may be partitioned such that four rooms, each 10 feet by 10 feet, are created by deploying a plurality of flexible, sound-attenuating walls intersecting and interlocking at various angles; a 10 feet by 10 feet space centered in the middle of a 20 feet by 20 feet space may be created by interlocking four flexible, sound-attenuating walls at various angles to each other.

Sound-attenuation is defined as reducing the level of sound that passes through a medium. In the instance of the material used in this invention, mass loaded vinyl, the material absorbs the energy created by sound waves thus reducing the transference of sound from one side of the material to the other side.

Interlocking system is defined as two individual, complimentary shaped connectors that, when engaged, join the materials to which they are connected at various angles. The interlocking system may include various embodiments of complimentary connectors. Each embodiment of the interlocking system comprises complimentary connectors that run the length of material to which they are joined.

DETAILED DESCRIPTION OF CERTAIN EMBODIMENTS

It will be readily understood that the components of the present invention, as generally described and illustrated in the Figures herein, may be arranged and designed in a wide variety of different configurations. Thus, the following more detailed description of the embodiments of the invention is not intended to limit the scope of the invention, as claimed, but is merely representative of certain examples of presently contemplated embodiments in accordance with the invention. The presently described embodiments will be best understood by reference to the claims and drawings.

Certain embodiments of the flexible, sound-attenuating wall system may include: interlocking two flexible, sound-attenuating walls at various angles inside another space utilizing two existing permanent walls and two flexible, sound-attenuating walls to form an enclosed space; interlocking three flexible, sound-attenuating walls at various angles to form a space inside another space utilizing one existing permanent wall and three flexible, sound-attenuating walls to form an enclosed space; or, interlocking four flexible, sound-attenuating walls at various angles to form a space inside another space where no existing permanent wall is used to form the enclosed space. Features and advantages of additional embodiments of the invention may become more fully apparent or may be learned by practice of the invention as set forth hereinafter.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION OF THE DRAWINGS

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
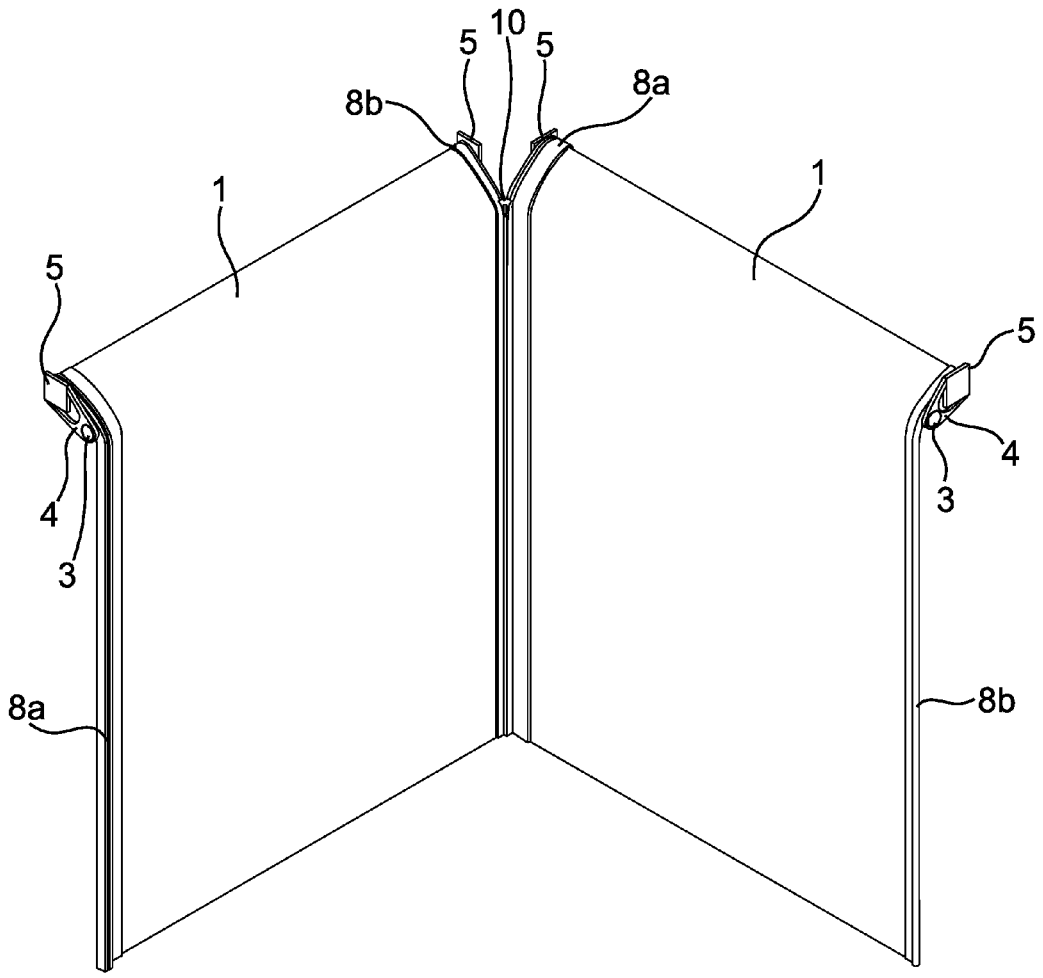
FIG. 1 is a perspective view of one embodiment comprising two flexible, sound-attenuating roll-up wall units, with the walls deployed and interlocked at an angle, mounting brackets, guide rollers, and the interlocking connection components.

FIG. 1 is a perspective view of one embodiment of the flexible, sound-attenuating roll-up wall system showing two units comprising flexible, sound-attenuating walls 1 intersecting at an angle. In this embodiment the flexible, sound-attenuating walls 1 are made of mass loaded vinyl. Also shown are the guide rollers 3 disposed above the flexible, sound-attenuating walls 1. The guide rollers 3 are made in one embodiment from aluminum. In other embodiments the guide rollers 3 comprise steel, stainless steel, brass, titanium, polyvinyl chloride, carbon fiber, wood, engineered wood, nylon, and plastic. The guide rollers 3 may be made in differing lengths based on application. Also shown are guide roller mounting brackets 4 and receiver tube mounting brackets 5. In one embodiment the mounting brackets 4 and 5 are made of aluminum. In other embodiments, the mounting brackets 4 and 5 are made of steel, stainless steel, brass, titanium, polyvinyl chloride, carbon fiber, nylon, polyoxymethylene, and plastic. Further shown is one embodiment of the catch coupling 8*a* disposed along the first vertical side of a sound-attenuating wall 1 and bead coupling 8*b* disposed along the second vertical side of another sound-attenuating wall 1. In one embodiment, catch coupling 8*a* and bead coupling 8*b* are made of rubber. In other embodiments, the couplings 8*a* and 8*b* are made of flexible carbon fiber and vinyl. Also shown is an interlocking connector slide 10 by which the catch coupling 8*a* of one flexible, sound-resistant wall unit 1 and bead coupling 8*b* of another flexible, sound-resistant wall unit 1 disposed adjacently are engaged by the slide 10 as the slide 10 is pulled in one direction of movement, and disengaged as the slide 10 is moved in the opposite direction.

Figure 2A:
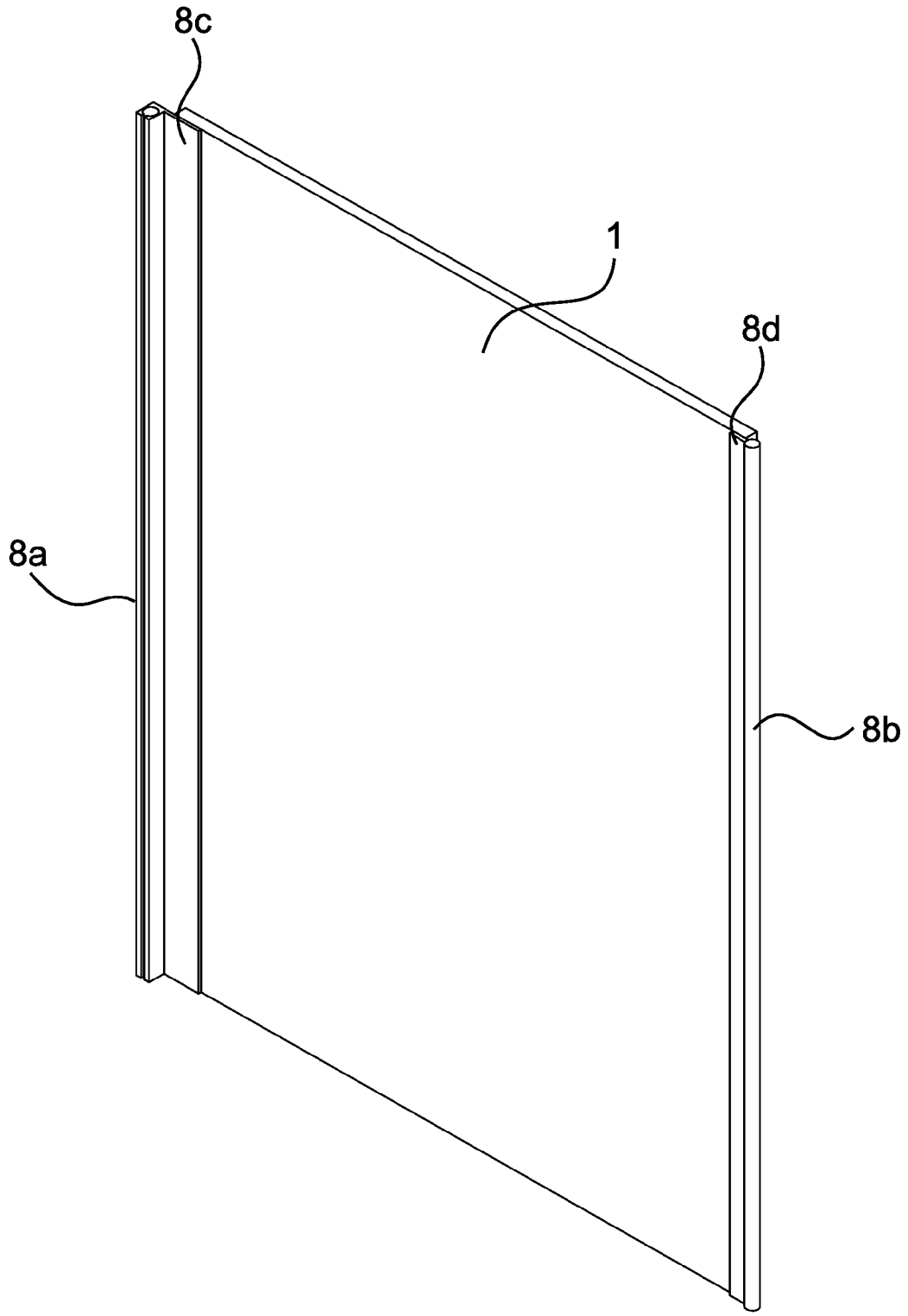
FIG. 2A is an isometric view showing the flexible, sound-attenuating wall in panel form with a depiction of one embodiment of the interlocking connector.

FIG. 2A shows one embodiment of a flexible, sound-attenuating wall 1, with catch coupling 8*a*, with extension 8*c*, disposed along a vertical side of a flexible, sound-attenuating wall 1. Bead coupling 8*b*, with extension 8*d*, is disposed along an opposed second vertical side of the same flexible, sound-attenuating wall 1. One surface of extension 8*c* is joined to a surface on one side of the flexible, sound-attenuating wall and one surface of extension 8*d* is joined to one surface of the flexible, sound-attenuating wall 1 along the opposed second side. The method of joining 8*c* and 8*d* to the flexible, sound-attenuating wall 1 comprises chemical and mechanical attachments.

Figure 2B:
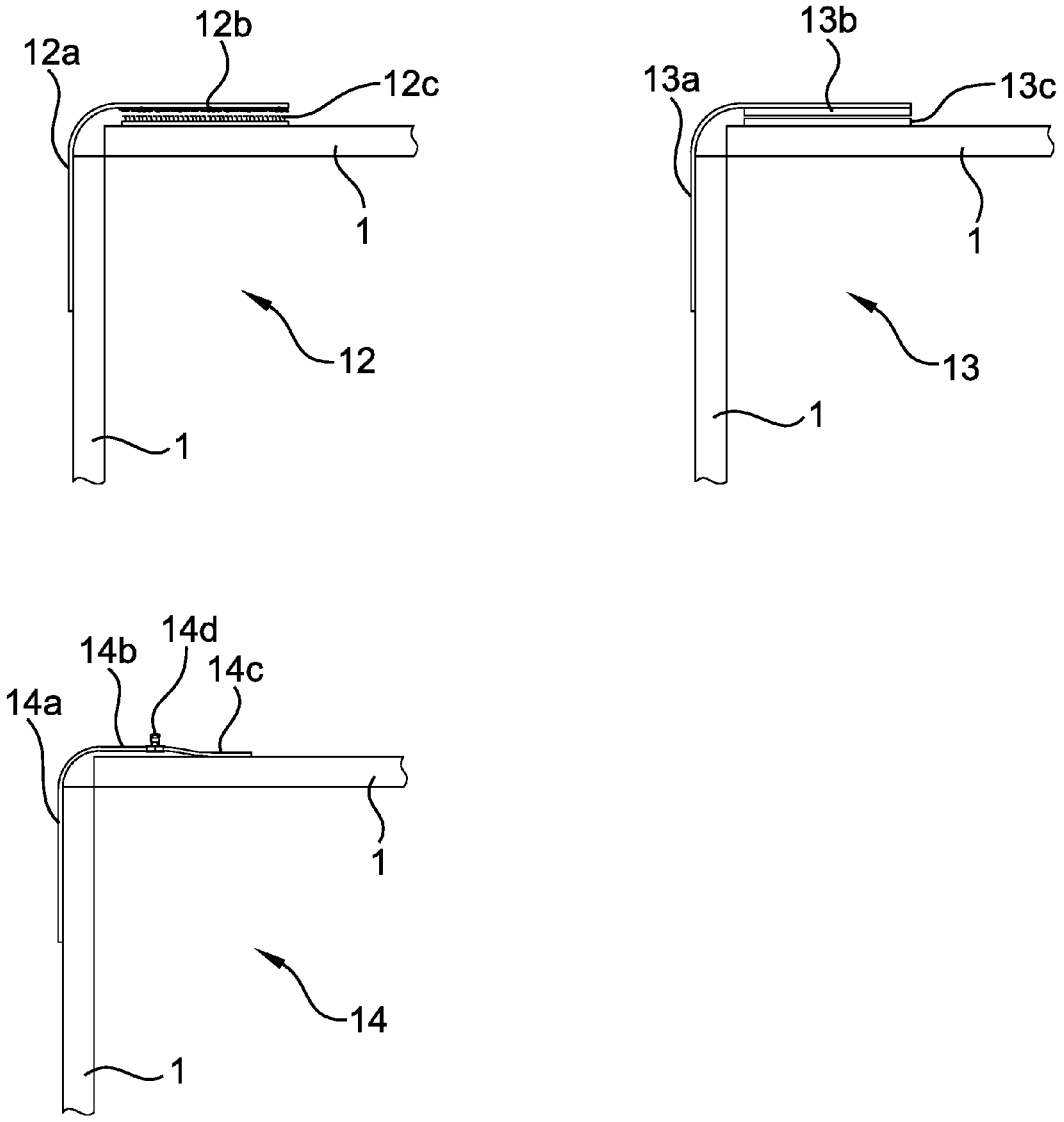
FIGS. 2B through 2D show plan views of two wall panels connected by additional embodiments of the interlocking connectors.

FIG. 2B shows plan views of additional embodiments of the interlocking connectors. View 12 depicts one embodiment of a first sound-attenuating wall 1, with binding 12*a* joined to one surface of a vertical side of the wall 1. On one side of binding 12*a* is joined a length of loop material 12*b* the full length of the binding 12*a* by way of chemical and mechanical attachments. Joined to one surface of a vertical side of a second sound-attenuating wall 1 is a length of hook material 12*c* disposed the full height of the wall 1. In other embodiments, binding 12*a* and hook material 12*c* are joined to the wall 1 on the opposite surface. Loop material 12*b* is interlocked with hoop material 12*c* to connect the sound-attenuating walls 1 at various angles. The binding 12*a* comprises cloth, vinyl, and mass-loaded vinyl. The binding 12*a* and hook material 12*c* are joined to the sound-attenuating walls 1 by way of chemical and mechanical attachments. View 13 depicts one embodiment of the sound-attenuating wall 1, with binding 13*a* joined to one surface of a vertical side of the wall 1. On one side of binding 13*a* is joined a length of magnetic material 13*b* the full length of the binding 13*a* by way of chemical and mechanical attachments. Joined to one surface of a vertical side of a second sound-attenuating wall 1 is a length of complimentary magnetic material 13*c* disposed the full height of the wall 1. In other embodiments, binding 13*a* and magnetic material 13*c* are joined to the wall 1 on the opposite surface. Magnetic material 13*b* is joined to magnetic material 13*c* to connect the sound-attenuating walls 1 at various angles. The binding 13*a* comprises cloth, vinyl, and mass-loaded vinyl. The binding 13*a* and magnetic material 13*c* are joined to the sound-attenuating walls 1 by way of chemical and mechanical attachments. View 14 depicts one embodiment of the sound-attenuating wall 1, with binding 14*a* joined to one surface of a vertical side of the wall 1. On one side of binding 14*a* is joined a length of zipper tape 14*b* the full length of the binding 14*a* by way of chemical and mechanical attachments. Joined to one surface of a vertical side of a second sound-attenuating wall 1 is a length of complimentary zipper tape 14*c* disposed the full height of the wall 1. Coupling zipper tape 14*b* to zipper tape 14*c* is slide 14*d*. Zipper tape 14*b* is interlocked with zipper tape 14*c* to connect the sound-attenuating walls 1 at various angles. The binding 14*a* comprises cloth, vinyl, and mass-loaded vinyl. The binding 14*a* and zipper tape 14*c* are joined to the sound-attenuating walls 1 by way of chemical and mechanical attachments.

Figure 2C:
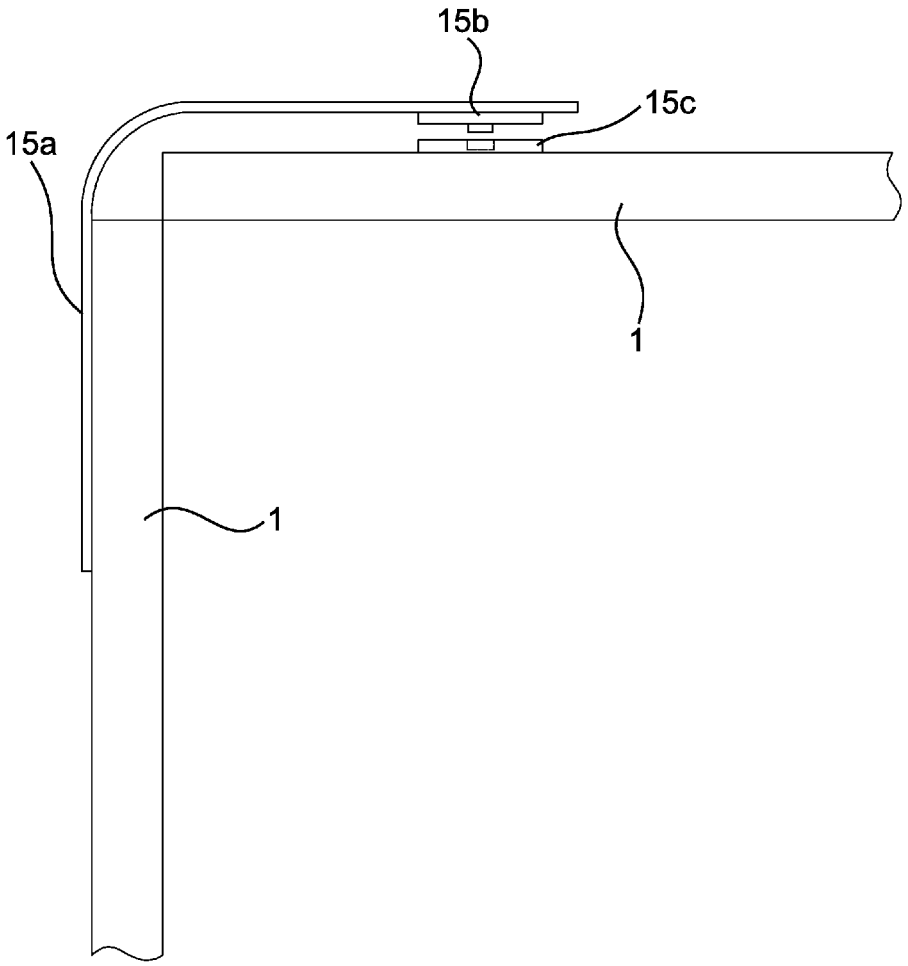

FIG. 2C provides a plan view of one embodiment of the flexible, sound-attenuating wall 1, with a first side of binding 15*a* joined to one surface of a vertical side of the wall 1. Along a second opposite side of binding 15*a* is joined a plurality of magnetic snap studs intermittently disposed the length of binding 15*a*. Joined to one surface of a vertical side of a second sound-attenuating wall 1 is a plurality of complimentary magnetic snap sockets 15*c* intermittently disposed the full height of the wall 1. In other embodiments, binding 15*a* and the complimentary magnetic snap sockets 15*c* are joined to the opposite surface of wall 1. The binding 15*a* is joined to the sound-attenuating wall by way of chemical and mechanical attachments. The magnetic snap studs 15*b* are mechanically attached to binding 15*a*. The magnetic snap sockets 15*c* are mechanically attached to the sound-attenuating wall 1. The magnetic snap studs 15*b* are joined to the magnetic snap sockets 15*c* to connect the sound-attenuating walls 1 at various angles. The binding 15*a* comprises cloth, vinyl, and mass-loaded vinyl. The magnetic snap studs 15*b* and magnetic snap sockets 15*c* comprise ferrous metals and magnets.

Figure 2D:
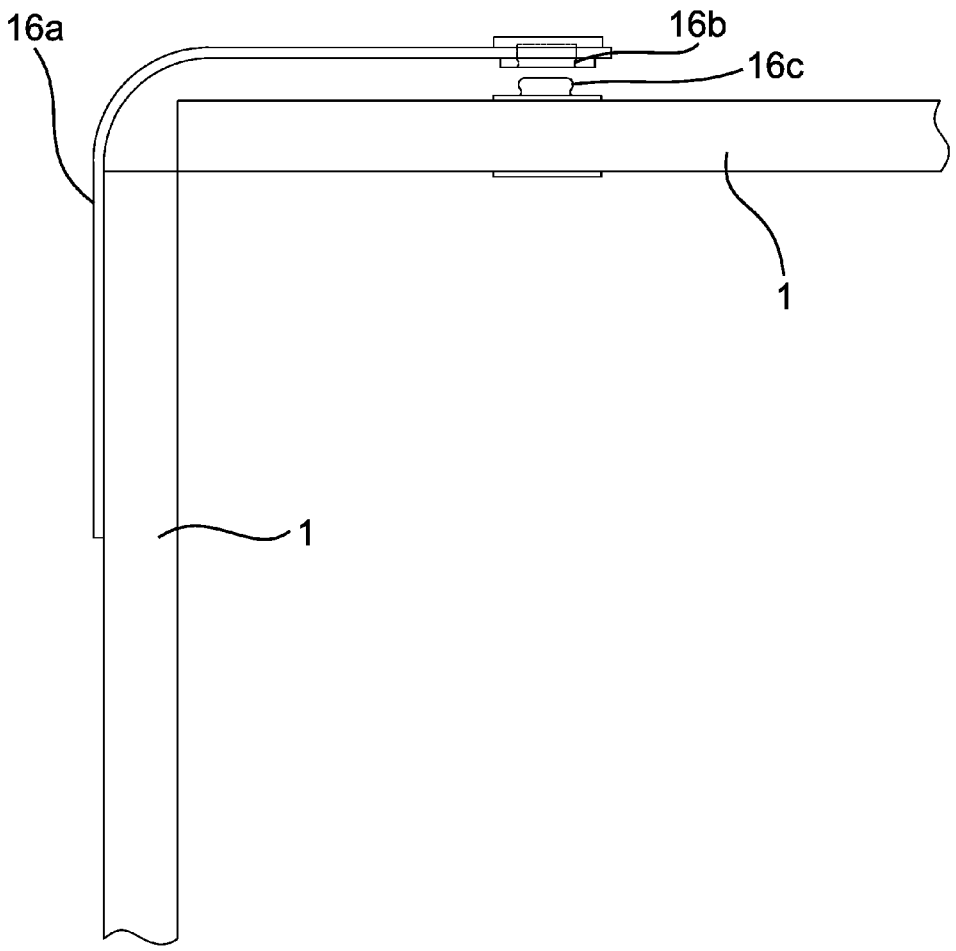

FIG. 2D provides a plan view of one embodiment of the sound-attenuating wall 1, with a first side of binding 16*a* joined to one surface of a vertical side of the wall 1. Along a second opposite side of binding 16*a* is joined a plurality of button snap sockets 16*b* intermittently disposed the length of said binding 16*a*. Joined to one surface of a vertical side of a second sound-attenuating wall 1 is a plurality of complimentary button snap studs 16*c* intermittently disposed the full height of the wall 1. In other embodiments, binding 16*a* and the complimentary button snap studs 16*c* are joined to the opposite surface of wall 1. The binding 16*a* is joined to the sound-attenuating wall by way of chemical and mechanical attachments. The button snap sockets 16*b* are mechanically attached to binding 16*a*. The button snap studs 16*c* are mechanically attached to the sound-attenuating wall 1. Button snap sockets 16*b* interlock with button snap studs 16*c* to connect the sound-attenuating walls 1 at various angles. The binding 16*a* comprises cloth, vinyl, and mass-loaded vinyl. The button snap sockets 16*b* and studs 16*c* are comprised of aluminum, titanium, brass, nylon, polyoxymethylene, polyvinyl chloride, plastic, and carbon fiber.

Figure 3:
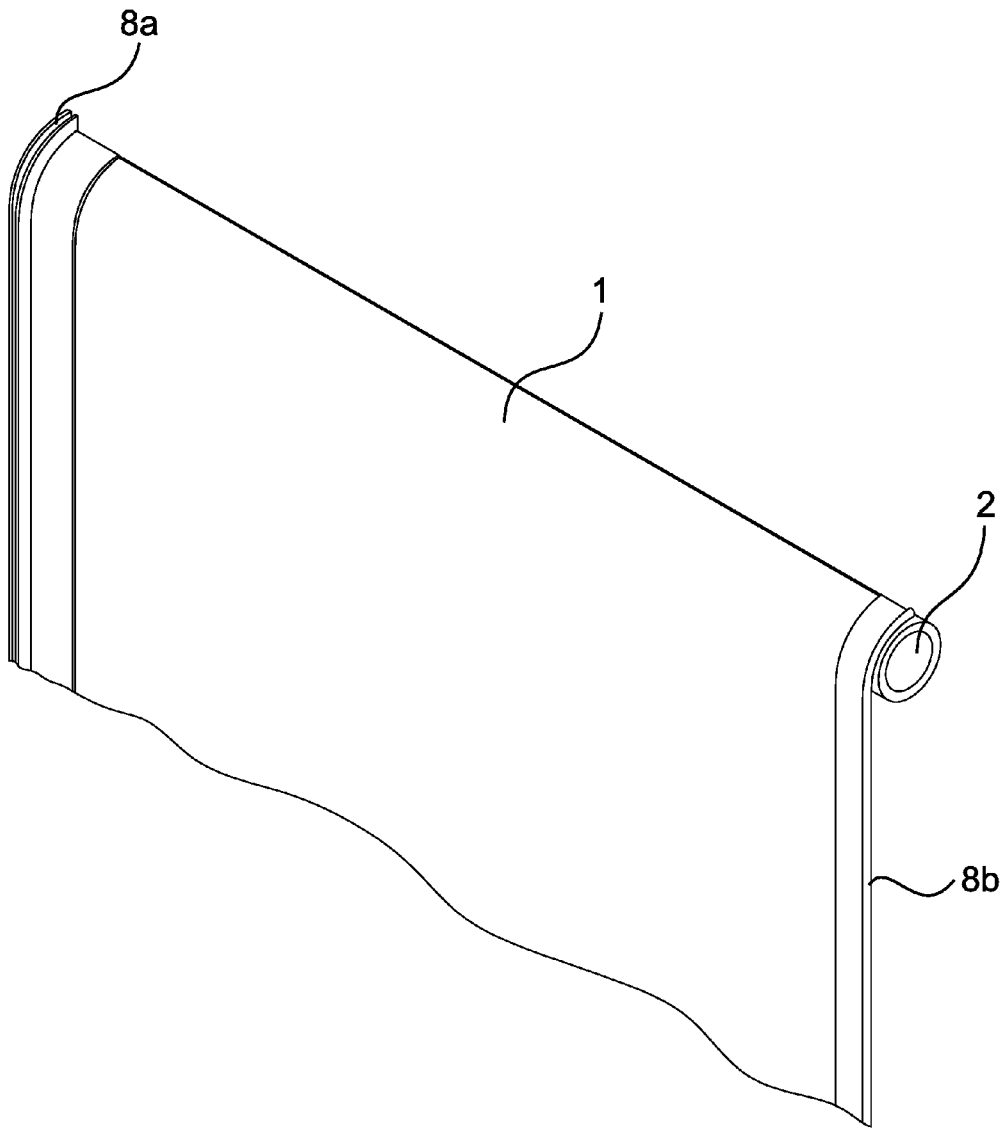
FIG. 3 is an isometric view of the flexible, sound-attenuating material connected to a receiver tube, with a depiction of one embodiment of the interlocking connector.

FIG. 3 is an isometric view depicting the flexible, sound-attenuating wall 1 connected to the receiver tube 2. The receiver tube may be embodied in various diameters and lengths. Also shown is one embodiment of the interlocking connectors, catch coupling 8*a* and bead coupling 8*b*.

Figure 4:
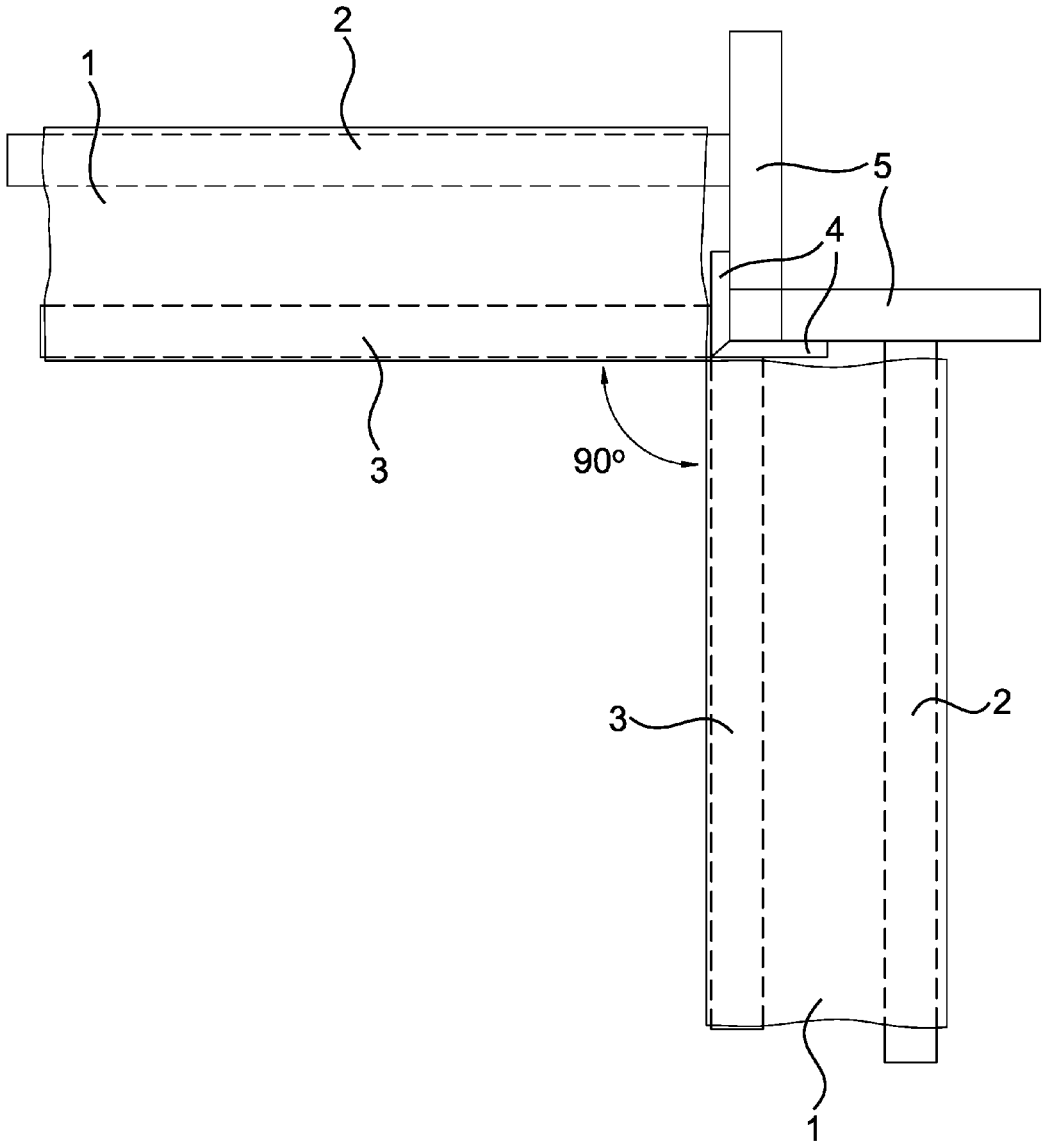
FIG. 4 is a plan view showing two flexible, sound-attenuating wall units at an angle to each other, depicting the flexible, sound-attenuating walls, receiver tubes, guide rollers, and mounting brackets.

FIG. 4 is a plan view showing two flexible, sound-attenuating wall units, flexible, sound-attenuating walls 1, receiver tubes 2, guide rollers 3, mounting brackets 4 for the guide rollers 3, and mounting brackets 5 for the receiver tubes 2. In this embodiment, mounting brackets 4 and 5, the receiver tube 2, and the guide roller 3 for one unit are at a right angle to the mounting brackets 4 and 5, the receiver tube 2, and guide roller 3 for another unit. In other embodiments, the angle at which the units are installed may be less than or greater than ninety-degrees. In this embodiment, the adjacent receiver tube mounting brackets 5 are fastened to each other for stability. In other embodiments, the mounting brackets 5 may be separated.

Figure 5:
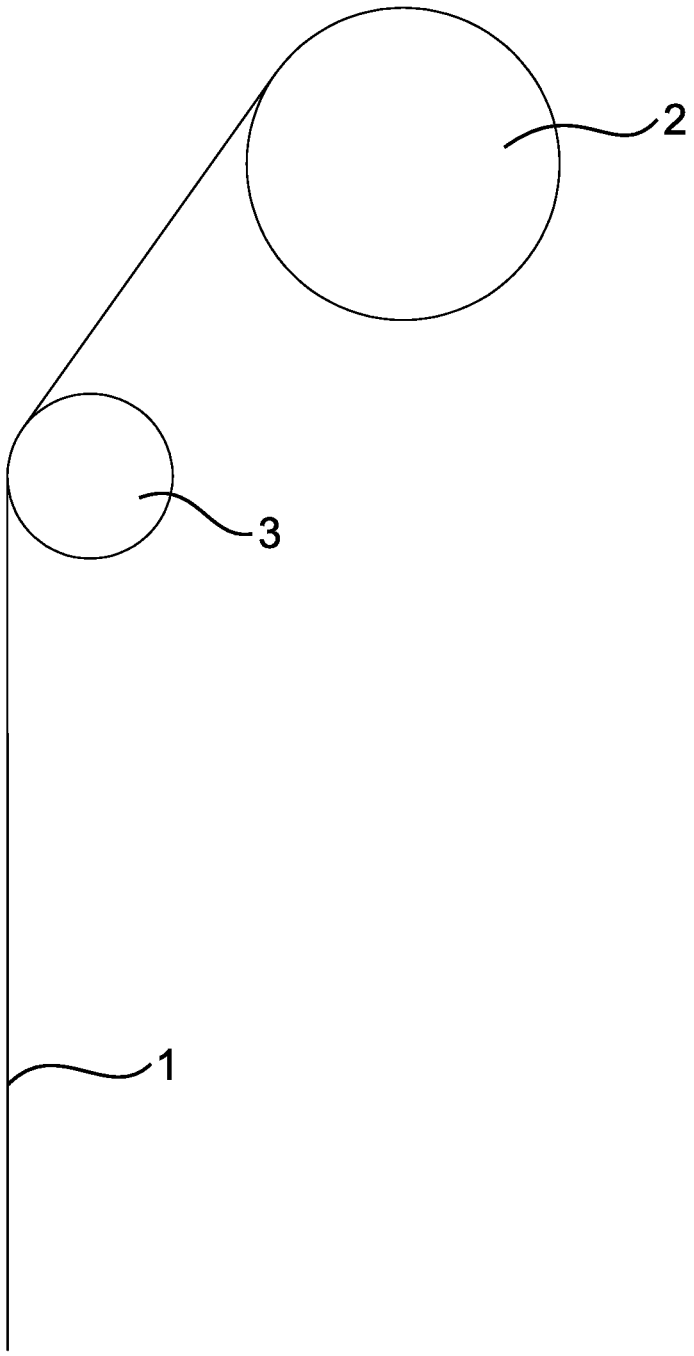
FIG. 5 is a profile view showing the flexible, sound-attenuating wall, receiver tube, and guide rollers.

FIG. 5 is a profile view showing the flexible, sound-attenuating wall 1, the receiver tube 2, and the guide roller 3. In this embodiment, the guide roller 3 is below and to the front of the receive tube 2. Placement of the receiver tube 2 and the guide roller 3 may vary based on application. In this embodiment, receiver tubes 2 are disposed above and to the rear of guide rollers 3 and the flexible, sound-attenuating walls 1. Guide rollers 3 are comprised of an elongated cylindrical element. The guide rollers 3 may be embodied in various diameters, and are used to direct the flexible, sound-attenuating walls 1 such that they intersect and interlock without distortion. Without guide rollers 3, the flexible, sound-attenuating walls 1 would hang directly below the receiver tubes 2, creating space between the flexible, sound-attenuating walls 1 and disallowing interconnection between the flexible, sound-attenuating walls 1.

Figure 6:
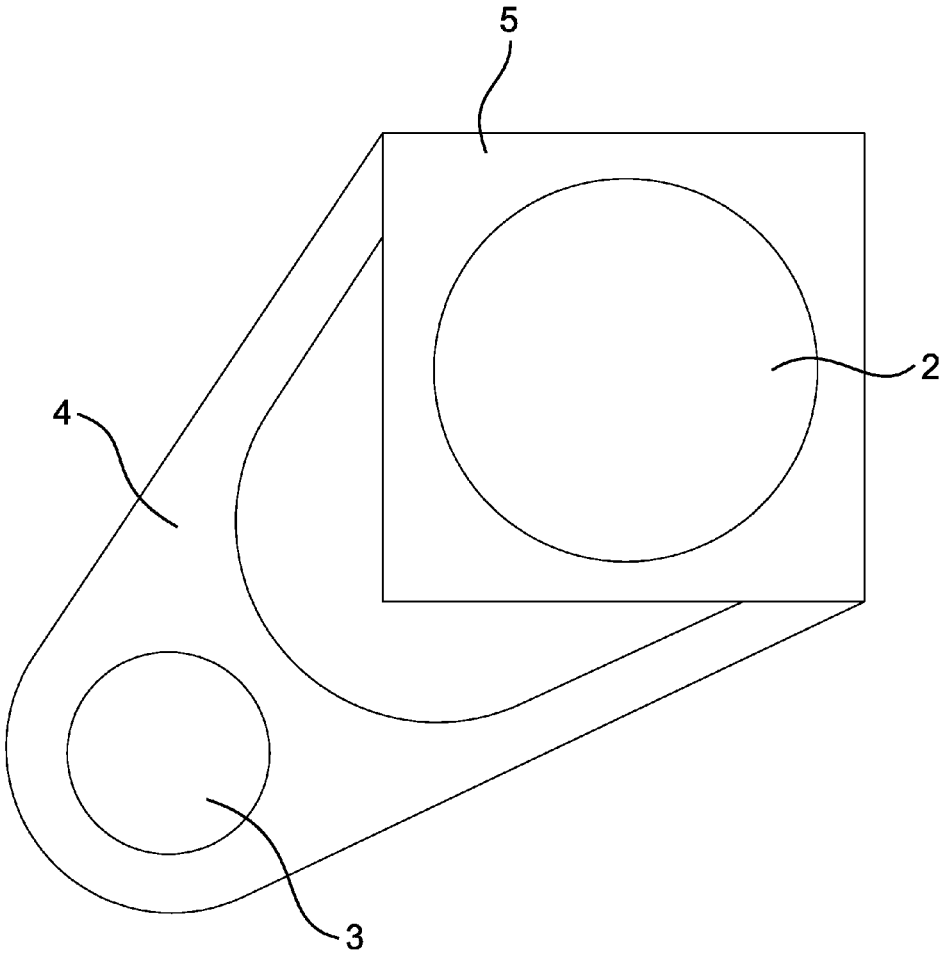
FIG. 6 is a profile view showing the receiver tube with mounting bracket and the guide roller with mounting bracket.

FIG. 6 shows a profile view of the receiver tube 2, the guide roller 3, a mounting bracket 5 for the receiver tube, and a mounting bracket 4 for the guide roller. In this embodiment the mounting brackets 4 and 5 are fastened to each other. In other embodiments mounting brackets 4 and 5 may be separate as application requires. In this embodiment, mounting bracket 4 is angled such that it places the guide roller 3 lower than and at an angle to the receiver tube 2. Mounting brackets 5 may be attached to a permanent wall or to a ceiling based on application. Mounting brackets 4 may be attached to a permanent wall or to mounting brackets 5 as required by application.

Figure 7:
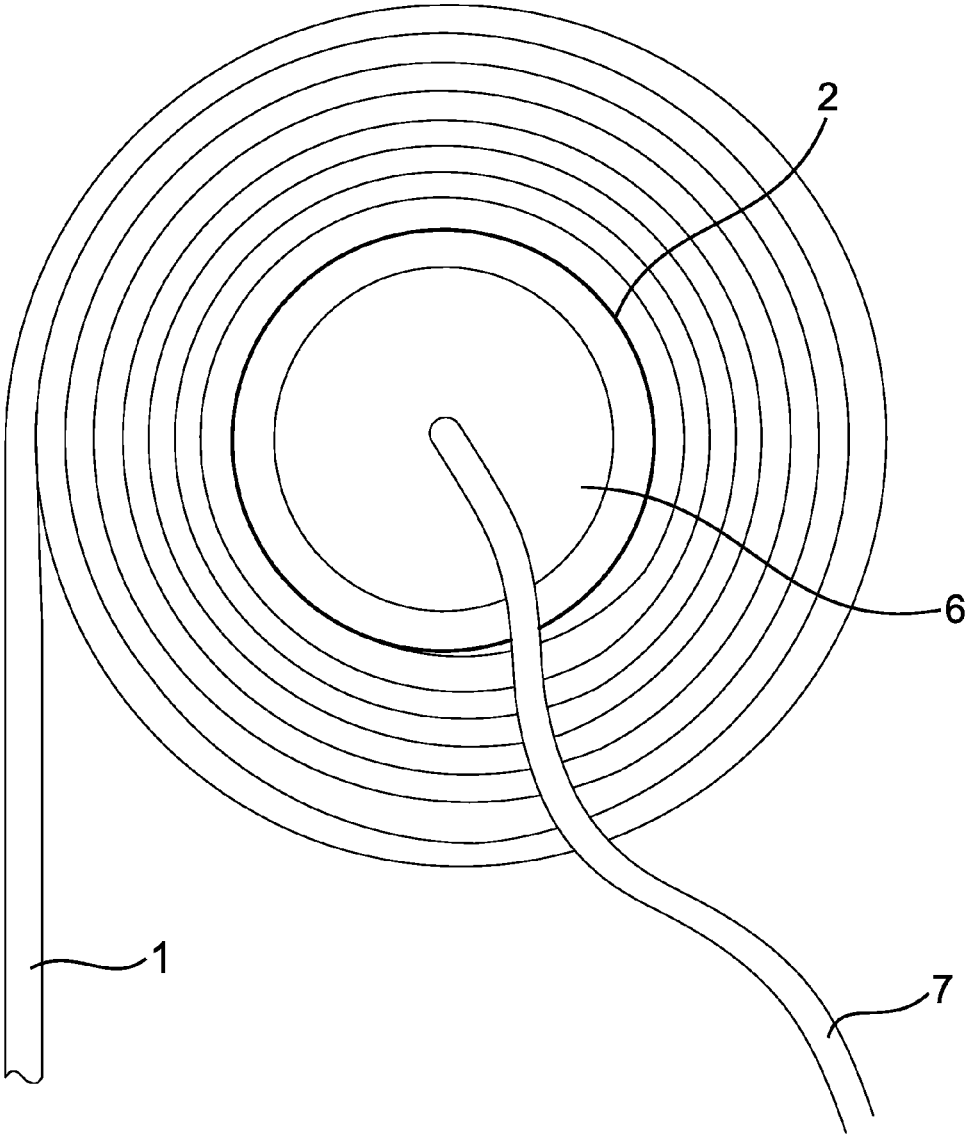
FIG. 7 is a profile view showing the flexible, sound-attenuating wall, the receiver tube, a winding mechanism, and a power cable to the winding mechanism.

FIG. 7 shows a profile view depicting the flexible, sound-attenuating wall 1 rolled onto the receiver tube 2, the winding mechanism 6, and a power cord 7 to the winding mechanism 6. The winding mechanism 6 is disposed inside and attached to the receiver tube 2. When engaged, the winding mechanism 6 turns the receiver tube 2 on its longitudinal axis to deploy or retract the flexible, sound-attenuating wall 1.

Figure 8A:
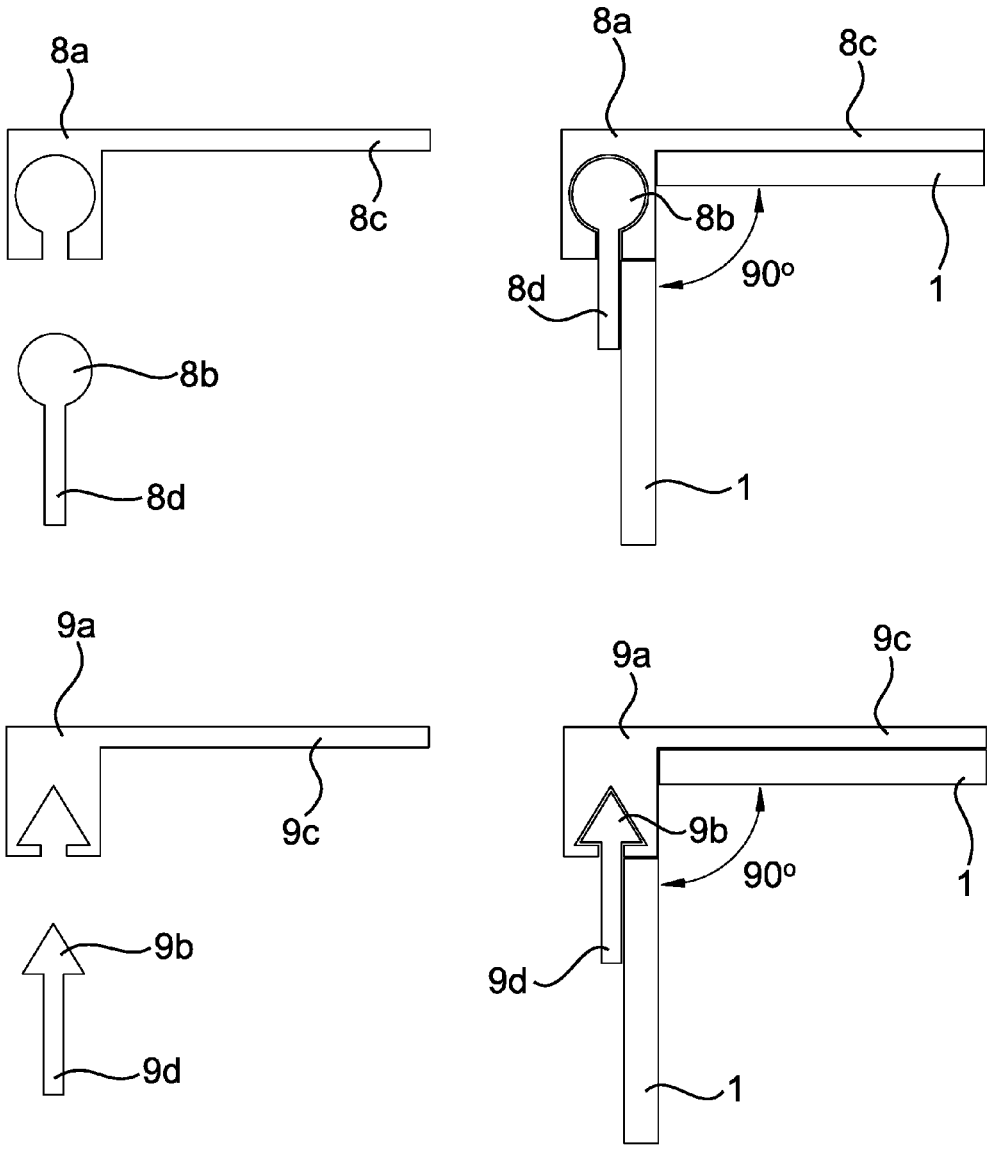
FIGS. 8A and 8*b* show views depicting various embodiments of two interlocking connectors.

FIG. 8A shows a plan view of two embodiments of the interlocking system complimentary connectors known as bead and catch couplings. 8*a* depicts one embodiment of a catch coupling and 8*b* depicts one embodiment of a bead coupling. 9*a* shows an alternative embodiment of the catch coupling and 9*b* shows an alternative embodiment of the bead coupling. Also shown are 8*c*, 8*d*, 9*c*, and 9*d*, each of which are flat extensions from the corresponding bead and catch couplings 8*a*, 8*b*, 9*a*, and 9*b*, with each said extension having a first flat surface and a second flat surface and an edge opposite said couplings. In one embodiment, the first flat surface of extensions 8*c*, 8*d*, 9*c*, and 9*d* is joined to the back surface of a flexible, sound-attenuating wall 1 along one vertical side. In another embodiment, the second flat surface of extensions 8*c*, 8*d*, 9*c*, and 9*d* is joined to the front surface of a flexible, sound-attenuating wall 1 along one vertical side. The flat surfaces of extensions 8*c*, 8*d*, 9*c*, and 9*d* are joined to the flexible, sound-attenuating wall 1 by chemical and mechanical attachments. The bead couplings 8*b* and 9*b* interlock with the catch couplings 8*a*, 9*a* to form a right angle connection between two flexible, sound-attenuating walls 1. Bead couplings 8*a* and 9*a*, and catch couplings 8*b* and 9*b* with extensions 8*c*, 8*d*, 9*c*, and 9*d* comprise rubber, flexible carbon fiber, and vinyl.

Figure 8B:
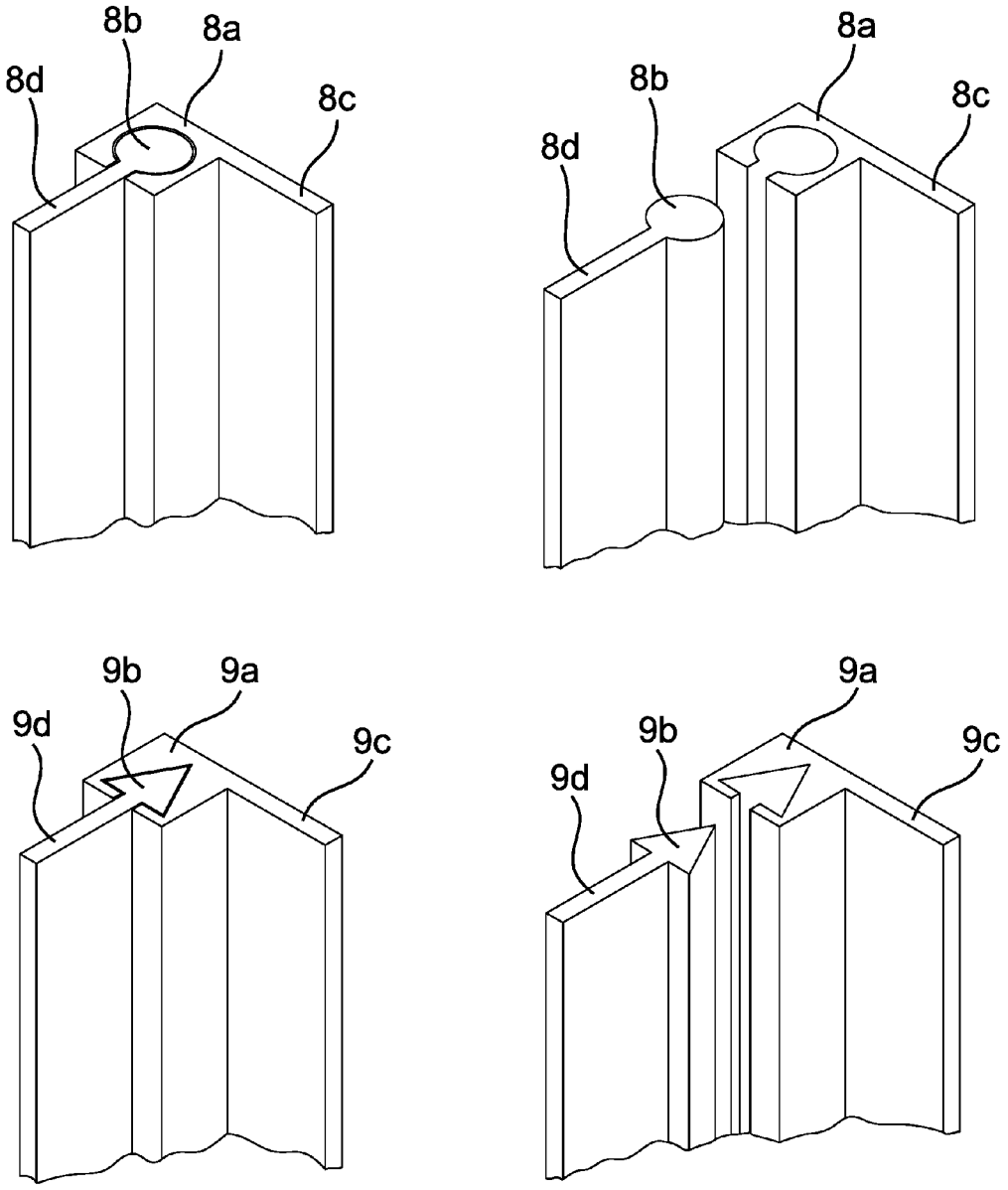

FIG. 8B shows two isometric views of the bead and catch connectors 8*a*, 8*b*, 9*a*, and 9*b*. In the first view, the beads 8*b* and 9*b* are continuously engaged with the catch 8*a* and 9*a* at right angles for the full length of each as may be required by application. In the second view, the beads 8*b* and 9*b* and the catch 8*a* and 9*a* are shown separated.

We claim:

1. A flexible, sound-attenuating roll-up wall system comprising:

a plurality of adjoining, flexible, sound-attenuating walls;

a receiver tube attached to each of the sound-attenuating walls, around which the sound-attenuating wall winds and unwinds;

a motor disposed inside and attached to each of the receiver tubes;

a guide roller disposed below and vertically offset to each of the receiver; and a plurality of mounting brackets, the mounting brackets comprising a first mounting bracket coupled to an end of each receiver tube and guide roller and a second mounting bracket coupled to an opposed second end of each receiver tube and guide roller, wherein each sound-attenuating wall comprises a first interlocking system along a vertical edge of the sound-attenuating wall and a second interlocking system along an opposed vertical edge of the sound-attenuating wall, the first interlocking system comprising a plurality of first connectors, and the second interlocking system comprising a plurality of second connectors complimentary to the first connectors, wherein the first and second connectors join and interlock the plurality of sound-attenuating walls at any angle between 1 and 180.

2. The flexible, sound-attenuating roll-up wall system of claim 1, wherein the flexible, sound-attenuating walls are made of mass loaded vinyl.

3. The flexible, sound-attenuating roll-up wall system of claim 1, wherein the receiver tubes comprise material which is selected from the group consisting of polyvinyl chloride, carbon fiber, wood, engineered wood, nylon, and plastic.

4. The flexible, sound-attenuating roll-up wall system of claim 1, wherein the receiver tubes comprise metal which is selected from the group consisting of steel, stainless steel, aluminum, brass, and titanium.

5. The flexible, sound-attenuating roll-up wall system of claim 1, wherein the motor disposed inside and attached to each of the receiver tubes turns the receiver tube on its longitudinal axis to raise or lower the flexible, sound-attenuating walls.

6. The flexible, sound-attenuating roll-up wall system of claim 1, wherein the flexible, sound-attenuating walls roll over the guide rollers to position the vertical edges of the flexible, sound-attenuating walls adjacently when unwound.

7. The flexible, sound-attenuating roll-up wall system of claim 1, wherein the guide rollers comprise metal which is selected from the group consisting of steel, stainless steel, aluminum, brass, and titanium.

8. The flexible, sound-attenuating roll-up wall system of claim 1, wherein the guide rollers comprise material which is selected from the group consisting of polyvinyl chloride, carbon fiber, wood, engineered wood, nylon, and plastic.

9. The flexible, sound-attenuating roll-up wall system of claim 1, wherein the first and second mounting brackets comprise metal selected from the group consisting of steel, stainless steel, aluminum, brass, and titanium.

10. The flexible, sound-attenuating roll-up wall system of claim 1, wherein the mounting brackets comprise material selected from the group consisting of polyvinyl chloride, carbon fiber, nylon, polyoxymethylene, and plastic.

11. The flexible, sound-attenuating roll-up wall system of claim 1, wherein the first connectors and complimentary second connectors are selected from a group consisting of bead and catch, zippers, hook and loop, snaps, magnetic snaps, and magnetic strips.

12. The flexible, sound-attenuating roll-up wall system of claim 1, wherein the first connectors and complimentary second connectors comprise materials selected from a group consisting rubber, vinyl, cloth, polyvinyl chloride, plastic, and vinyl magnet.

13. The flexible, sound-attenuating roll-up wall system of claim 1, wherein the first connectors and complimentary second connectors comprise metal selected from a group consisting brass, aluminum and nickel.

14. The flexible, sound-attenuating roll-up wall system of claim 1, wherein the first connectors and complimentary second connectors are joined to the sound-attenuating walls using chemical or mechanical attachments.

* * * * *